US005191351A

United States Patent [19]

Hofer et al.

[11] Patent Number: 5,191,351

[45] Date of Patent: Mar. 2, 1993

[54] FOLDED BROADBAND ANTENNA WITH A SYMMETRICAL PATTERN

[75] Inventors: Dean A. Hofer, Richardson; Matthew L. Pecak, Allen, both of Tex.

[73] Assignee: Texas Instruments Incorporated, Dallas, Tex.

[21] Appl. No.: 458,877

[22] Filed: Dec. 29, 1989

[51] Int. Cl.[5] ..... H01Q 1/36

[52] U.S. Cl. ..... 343/895; 343/708; 343/821

[58] Field of Search ..... 343/705, 708, 872, 803, 343/804, 895, 806, 807, 873, 828, 905, 821

[56] References Cited

U.S. PATENT DOCUMENTS

| | | | |
|---|---|---|---|
| 2,459,357 | 1/1949 | Bell | 343/708 |
| 2,514,992 | 7/1950 | Edelsohn | 343/803 |
| 2,991,474 | 7/1961 | Donnellan et al. | 343/895 |
| 3,079,602 | 2/1963 | Du Hamel et al. | 343/807 |
| 3,623,162 | 11/1971 | Whitty | 343/708 |
| 3,681,771 | 8/1972 | Lewis et al. | 343/821 |
| 3,774,220 | 11/1973 | Martin et al. | 343/803 |
| 3,868,694 | 2/1975 | Meinke | 343/701 |
| 3,969,730 | 7/1976 | Fuchser | 343/770 |
| 4,658,264 | 4/1987 | Baker | 343/895 |
| 4,697,192 | 9/1987 | Hofer et al. | 343/895 |
| 4,725,475 | 2/1988 | Fiscus et al. | 343/872 |
| 4,746,867 | 5/1988 | Gunton | 343/797 |

*Primary Examiner*—Rolf Hille
*Assistant Examiner*—Hoanganh Le
*Attorney, Agent, or Firm*—Rene'E. Grossman; Richard L. Donaldson

[57] ABSTRACT

A folded broadband antenna provides a symmetrical radiation pattern comparable to corresponding planar antennas (such as a planar spiral). The folded antenna can be integrated into a leading edge radome, eliminating the forward antenna cavity, and thereby, eliminating the internal wall reflections that cause radiation pattern distortion. A broadband antenna (61/62), such as an archimedean spiral, is folded at an apex area (64) that includes a fold-slot (66). The fold-slot enhances flexure, and allows a center-feed balun shielding tube (84) to extend into close proximity to the antenna aperture (61) for increased balun shielding.

55 Claims, 8 Drawing Sheets

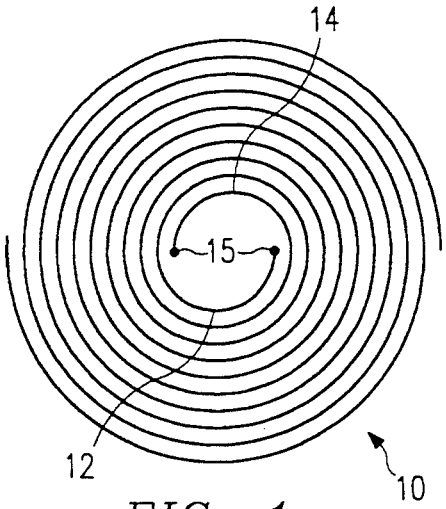
FIG. 1a
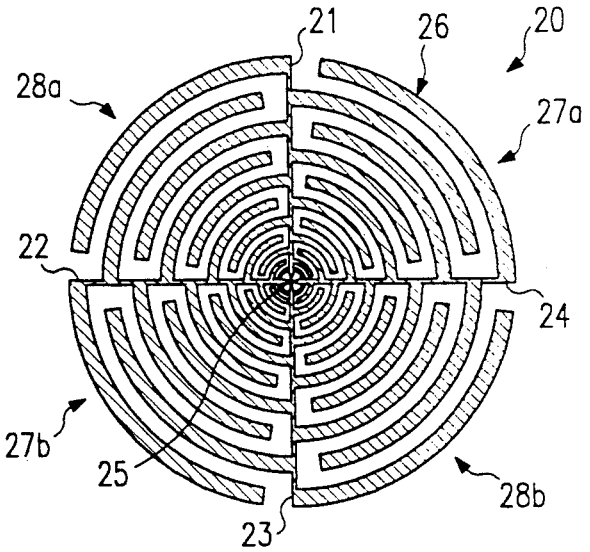
FIG. 1b
FIG. 1c
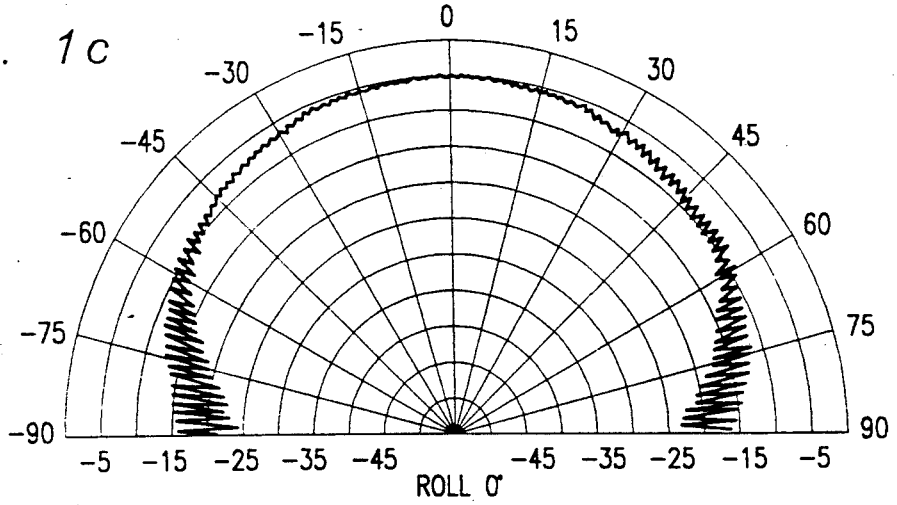
FIG. 1d
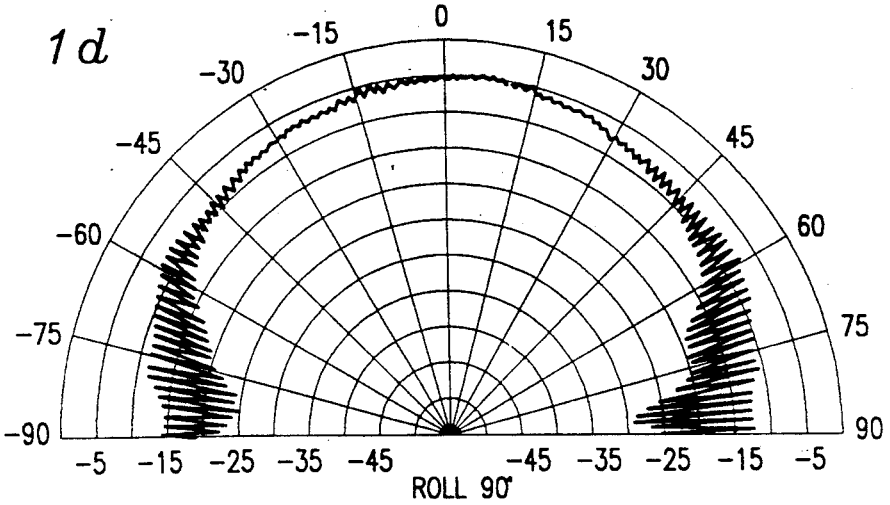

FIG. 2a
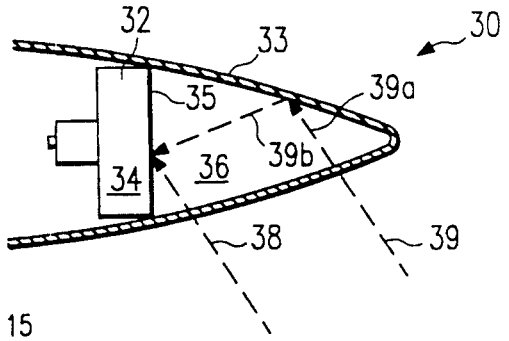
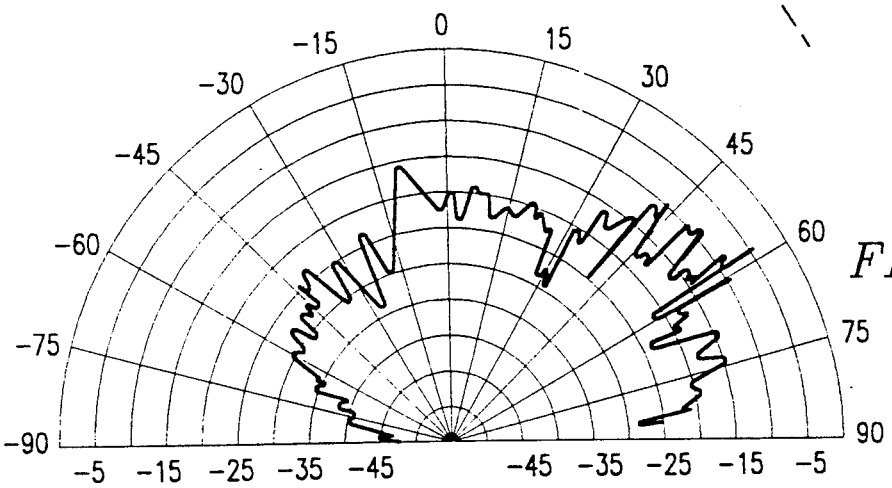
FIG. 2b
FIG. 3a
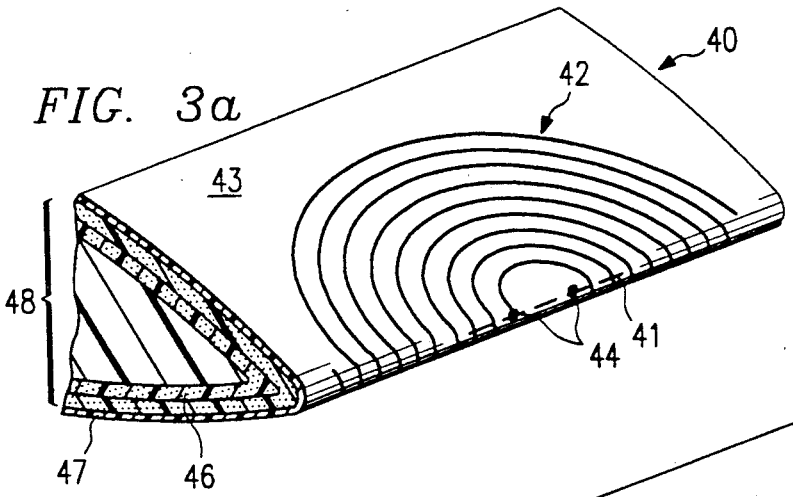
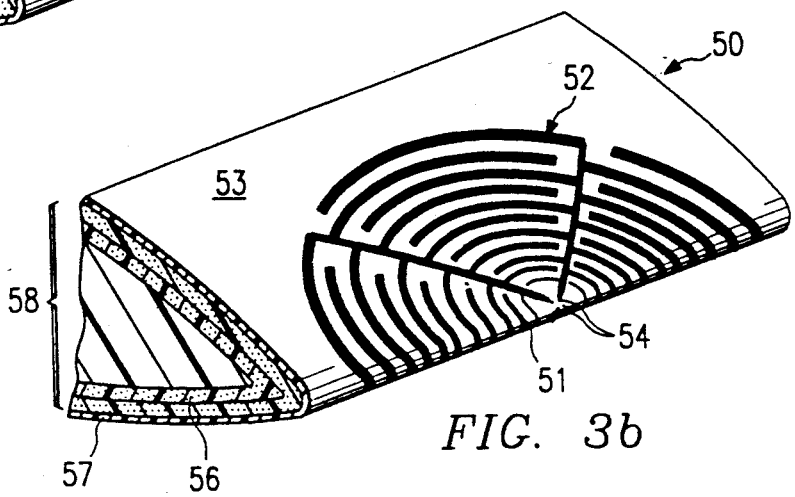
FIG. 3b

ROLL 0° 6GHz

ROLL 0° 14GHz

ROLL 90° 6GHz

ROLL 90° 14GHz

CONICAL 30°

6.0 GHz

CONICAL 30°

14.0 GHz

CONICAL 60°

6.0 GHz

FOLDED BROADBAND ANTENNA WITH A SYMMETRICAL PATTERN

TECHNICAL FIELD OF THE INVENTION

This invention relates in general to antennas, and more particularly to a folded configuration for, and a method of implementing, a broadband antenna that has a symmetrical antenna radiation pattern.

RELATED APPLICATIONS

This application relates to copending U.S. patent application Ser. No. 07/339,774, filed Apr. 18, 1989, now abandoned, titled "A Compact Multi-polarized Broadband Antenna", which was filed in the name of one of the inventors of this invention, and is assigned to the assignee of this invention. The subject matter disclosed in this related application is incorporated into this application by reference.

BACKGROUND OF THE INVENTION

For many military electronic systems that receive and/or transmit electromagnetic radiation, broadband (frequency independent) performance is advantageous or even required. One common class of broadband antennas uses a planar spiral configuration—either archimedean or logarithmic.

For many of these applications, the operating environment requires the antenna structure to be protectively enclosed within a radome made of a dielectric material. Thus, the antenna is required to "look through" the radome.

Typically, although these antennas are bi-directional (radiating forward and backward), forward-looking unidirectional performance is required to avoid undesirable, reflections from the cavity backing. Thus, these antennas are backed by an absorber filled cavity that absorbs radiation on the backside of the antenna plane.

Broadband absorber-cavity-backed planar spiral antennas are capable of providing symmetrical fixed beam radiation patterns over multi-octave bandwidths when operating in a free space environment, i.e., without the radome structure. When placed within the radome, performance is usually degraded due to distortions introduced by the radome, with the degree of degradation in symmetrical broadband performance being dependent upon radome configuration.

If a broadband planar spiral antenna is placed within a hemispherical-shaped radome, the broadband symmetrical performance, although somewhat degraded, is still acceptable for many applications. However, many applications, including most of those for aircraft or missile radar systems, require that radome shape be dictated by aerodynamic considerations (both in terms of streamlining and structural integrity) rather than to accommodate antenna structures. For many of these applications, a hemispherical radome is impractical.

An example of an aerodynamically-shaped radome is the sharply-tapered ogive geometry, commonly used for aircraft/missile applications. Locating a broadband planar spiral antenna within such a streamlined radome increases radome-induced distortions, and therefore, further degrades symmetrical broadband performance over that for hemispherically-shaped radomes. Nevertheless, for some applications, even this increased level of broadband symmetrical performance degradation is acceptable.

Unfortunately, the nose of an aircraft or missile is a prime antenna location that cannot accommodate all of the desired antenna structures, even where collocation techniques are used to permit the sharing of a common antenna aperture. One alternative location for an antenna structure that still allows forward looking operation is the leading edge of a wing.

The leading edge geometry of a wing is such that the aerodynamic streamlining requirements for a radome with a leading edge profile are even more severe than for nosecone radomes. Specifically, a radome with a corresponding leading edge profile causes even more distortion than the symmetrical nosecone radome because its folded, wedge-shaped geometry is not only severely streamlined, but is also highly asymmetrical.

Because of the severely tapered geometry of a leading edge radome, a planar antenna must of necessity be located back from the radome shell apex, leaving a forward cavity between the antenna structure and the radome. As a result, the antenna unavoidably receives not only the direct-path signal from the source, but also a multi-path signal reflected from the internal wall of the radome. These internal wall reflections are more severe in the case of the asymmetrical leading edge geometry than for a symmetrical geometry (such as an ogive) because they are concentrated in the elevation dimension. As a result, the elevation radiation pattern is severely distorted, and for most applications is essentially useless.

The degradation in pattern performance for an antenna structure located in a leading edge radome severely restricts the utility of a broadband symmetrical antenna structure for Direction Finding and most other applications. Thus, heretofore, broadband planar spiral (or other symmetrical) antenna structures have not been located in the leading edge of an aircraft wing.

One approach to solving the problem of locating a broadband antenna in the leading edge of an aircraft wing is disclosed in U.S. Pat. 4,697,192 "Two Arm Planar/Conical/Helix Antenna", issued Sep. 29, 1987 to the same inventors and assignee as the invention disclosed and claimed herein. This patent addressed the leading-edge radome problem by developing a planar/-conical/helix antenna structure to fit farther forward within the leading edge profile than would be possible with a planar antenna with comparable performance. However, this antenna is still required to "look through" the radome; in particular, the planar/-conical/helix antenna cannot be made integral with the leading edge radome shell. Thus, while its broadband radiation pattern is significantly improved over that which would be obtained from a conventional planar spiral antenna, it still is subject to substantial pattern degradation due to radome induced problems.

Accordingly, a need exists for a broadband antenna structure whose profile conforms to the asymmetrical folded radome shell, such as for incorporation into the leading edge of an aircraft wing. Preferably, the antenna would provide substantially symmetrical performance for both azimuth and elevation, with pattern and gain performance similar to that available from conventional planar broadband antennas.

SUMMARY OF THE INVENTION

The present invention is a folded broadband antenna structure that has a folded, wedge-shaped geometry (such as for incorporation into the leading edge radome of an aircraft wing) that provides substantially symmetrical radiation patterns in two dimensions (elevation as well as azimuth), providing uniform pattern and gain performance similar to a conventional planar spiral antenna.

In one aspect of the invention, a folded broadband antenna includes a broadband antenna aperture with substantially the same configuration as a planar antenna aperture characterized by a substantially symmetrical radiation pattern, disposed on a folded substrate with a substantially wedge-shaped cross-sectional profile. The folded broadband antenna exhibits a substantially symmetrical radiation pattern that is comparable in broadband symmetrical performance to the planar antenna.

Preferably, the broadband antenna configuration is either an archimedean spiral or a planar interleaved log periodic ("InterLog") as disclosed in the related application. The folded broadband antenna structure can be integrated into a radome with an asymmetrical wedge-shaped cross-sectional geometry, such as for incorporation into the leading edge geometry of an aircraft wing.

In more specific aspects of the invention, the folded broadband antenna is integrated with a radome shell having a leading edge geometry for incorporation into an aircraft wing.

The antenna aperture is formed on a rigid fiberglass substrate. A central fold-slot is milled in the substrate, defining a line of geometrical symmetry for the antenna structure which includes the center feedpoint of the antenna. The fold-slot provides an area of flexure for folding the antenna structure to achieve the desired leading-edge profile.

The antenna structure is folded over an absorber-loaded cavity backing having the selected leading-edge geometry. The fold-slot area of the antenna structure forms a rounded apex region that includes the center feedpoint of the antenna structure. The absorber is formed by a three-layer graded absorber covered with a structural foam spacer, in accordance with conventional broadband absorber cavity design.

For an archimedean spiral aperture, an axial outboarded balun is required for signal extraction at the center feedpoint on the folded antenna apex. A copper shielding tube is disposed through the cavity-backing absorber material, terminating in close proximity to the center feedpoint at the antenna apex. A tapered-wedge balun is inserted through the shielding tube and coupled to the two conductive spiral arms at the center feedpoint for signal extraction.

For a log periodic antenna aperture, a microstrip infinite balun is integrally formed along a radial transmission line connecting the interleaved log periodic dipole elements that form the antenna aperture. Radar signals received by the corresponding dipole elements of the antenna active region transmit to the central feedpoint at the folded antenna apex, and are coupled to the microstrip balun, which transports the signals radially outward to the antenna edge for signal extraction.

The resulting folded broadband antenna structure can be integrated into a radome shell using conventional radome fabrication techniques, such as by bonding a pre-fabricated radome shell to the folded antenna structure, or by fabricating the radome shell directly over the folded antenna.

The technical advantages of the invention are as follows. The folded broadband antenna structure can be configured with a selected wedge-shaped geometry, such as the leading edge geometry of an aircraft wing. The folded broadband antenna configuration is adaptable to antenna configurations corresponding to planar broadband symmetrical antennas such as the log periodic antenna of the related application and planar spiral antennas. The folded configuration achieves radiation pattern, field-of-view, and gain performance comparable to corresponding planar antenna configurations. The folded antenna structure can be fabricated with a central fold-slot in the antenna substrate, providing flexure for folding, and in the case of the spiral antenna configurations, allowing a balun shielding tube for an axial balun to be extended into closer proximity to the antenna aperture. The, folded broadband antenna structure can be integrated into a radome shell structure, eliminating any forward cavity, and thereby, eliminating radiation-pattern distortion caused by multi-path signals from internal radome wall reflections. Integration into the radome shell can be accomplished either by bonding the antenna structure to a leading-edge profiled radome shell, or by forming the radome shell directly over the folded antenna structure.

BRIEF DESCRIPTION OF THE DRAWINGS

For a more complete understanding of the present invention, and for further features and advantages, reference is now made to the following Detailed Description, taken in conjunction with the accompanying Drawings, in which:

FIGS. 1*a* and 1*b* respectively illustrate planar archimedean spiral and planar log periodic antenna apertures;

FIGS. 1*c* and 1*d* illustrate typical radiation patterns for the planar archimedean spiral and log periodic antenna apertures operating in free space (no radome);

FIG. 2*a* illustrates a planar antenna structure incorporated into a wedge-shaped radome shell with a leading edge profile, illustrating the internal radome wall reflections in the forward cavity that yield multi-path radar signals;

FIG. 2*b* is an elevation radiation pattern for the planar antenna incorporated into a leading edge radome, illustrating the distortion caused by multi-path internal wall reflections;

FIGS. 3*a* and 3*b* illustrate folded antenna configurations according to the invention, respectively with archimedean spiral and log periodic antenna apertures;

DETAILED DESCRIPTION OF THE INVENTION

Figure 4A:
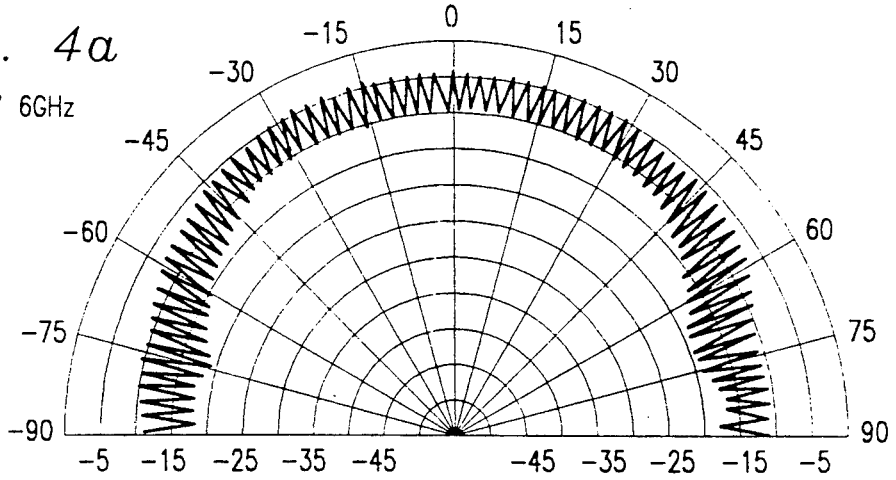
FIGS. 4*a*–4*h* are illustrative radiation patterns.
Figure 4B:
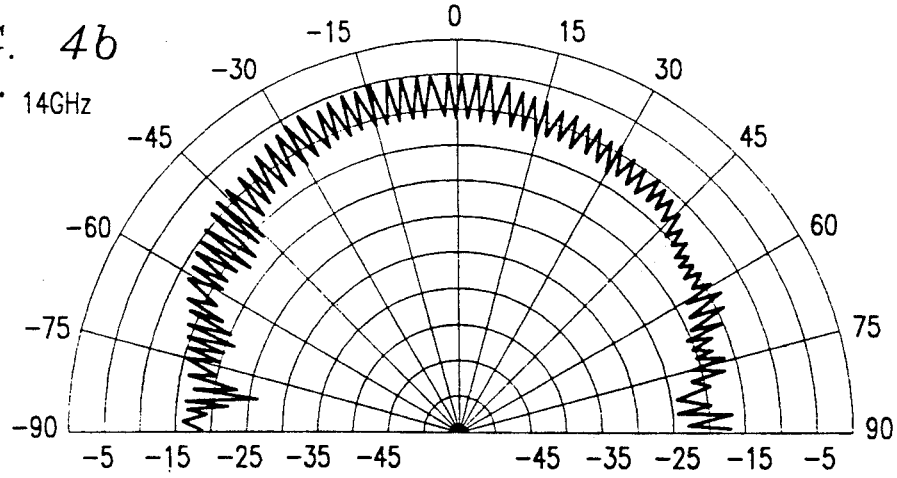
Figure 4C:
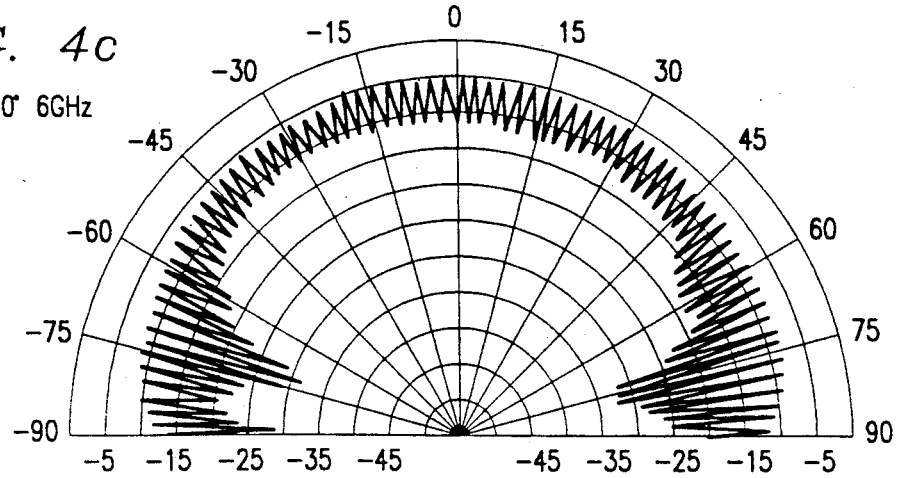
Figure 4D:
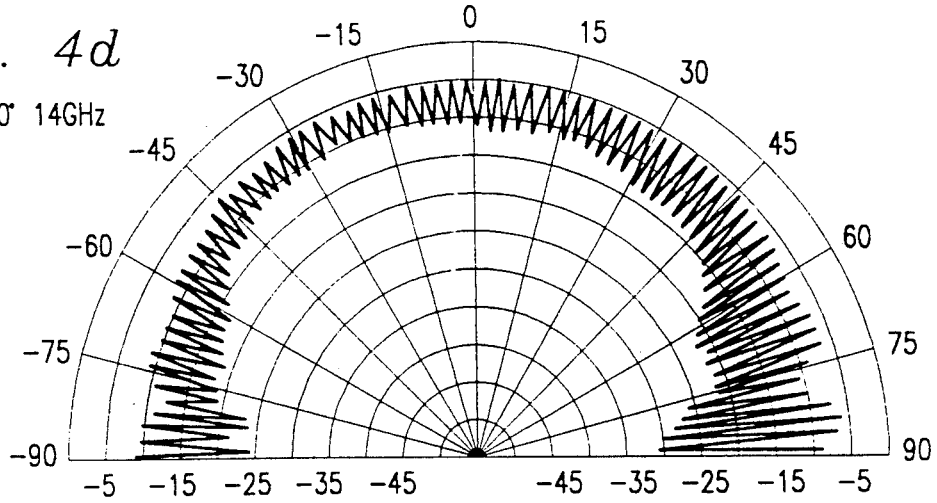
Figure 4E:
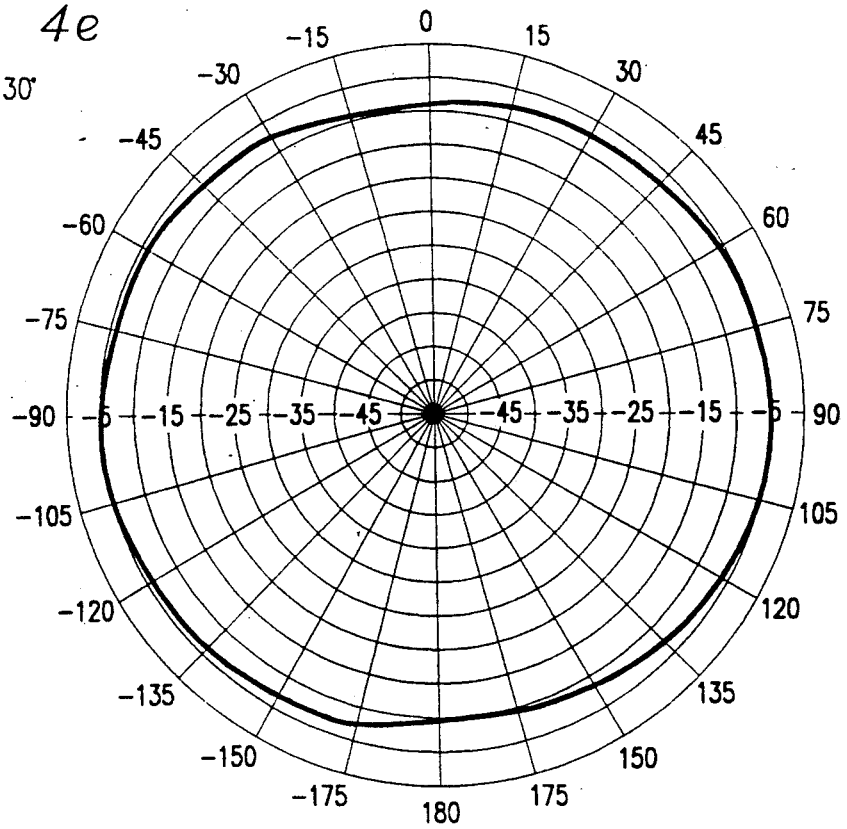
Figure 4F:
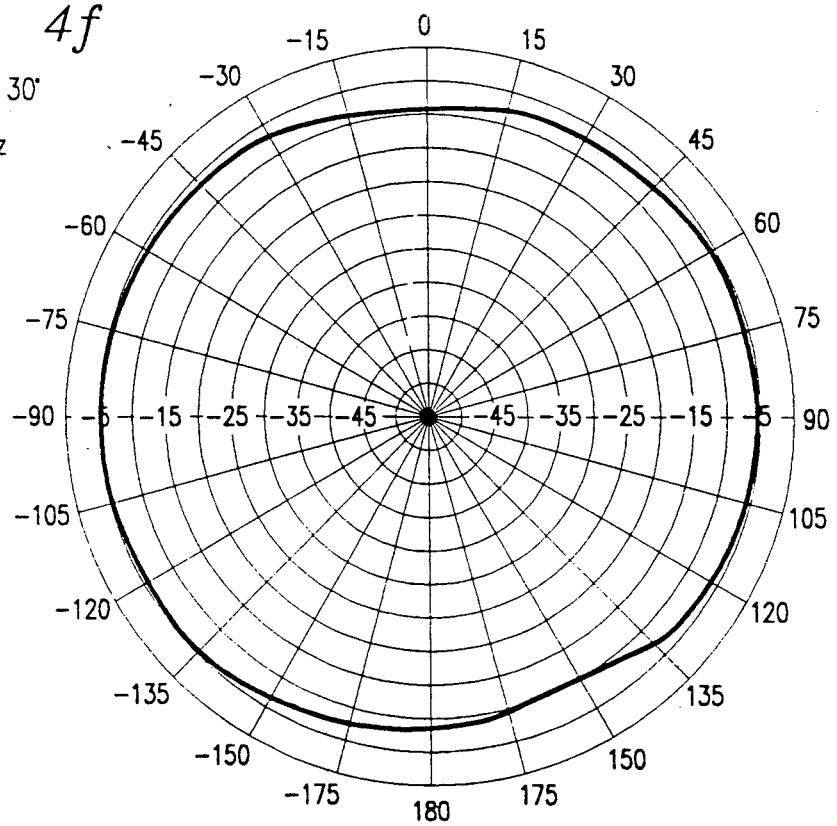
Figure 4G:
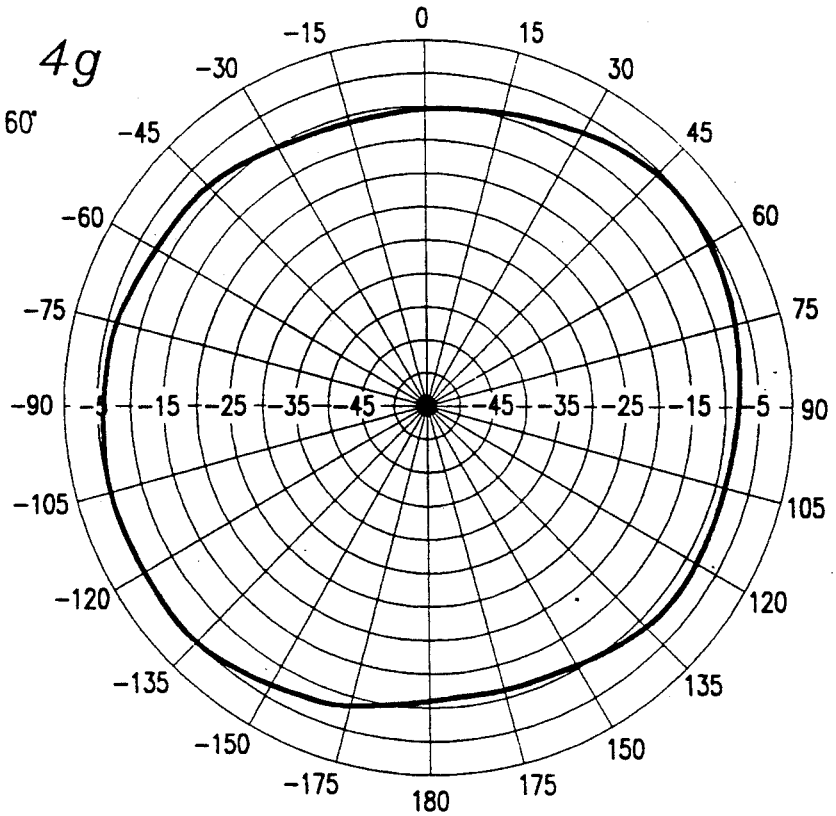
Figure 4H:
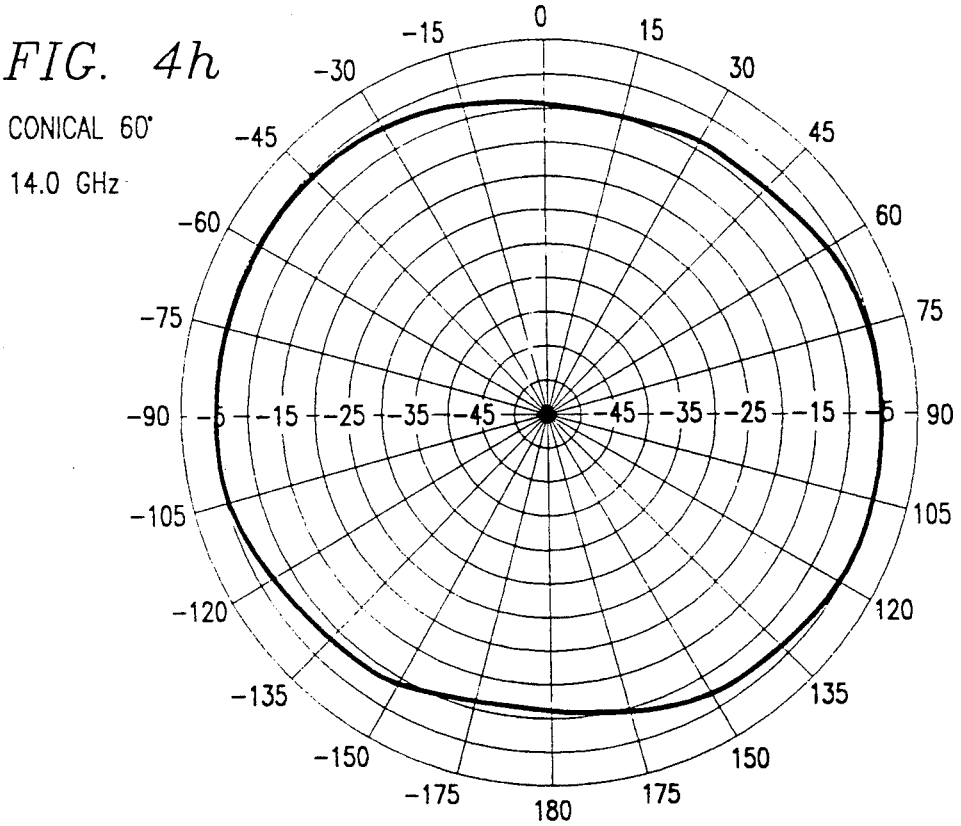

This Detailed Description incorporates by reference the disclosure in the related application.

The Detailed Description of exemplary embodiments of the folded broadband antenna structure of the invention is organized as follows:

1. Symmetrical Broadband Antennas
2. Leading-Edge Radome Induced Distortion
3. Folded Broadband Antenna
   3.1. Folded Antenna Aperture 3.2. Antenna Performance
3.3. Antenna Structure
3.4. Balun Feed
3.4.1. Center-Feed
3.4.2. Edge-Feed
4. Integration Into A Leading-Edge Radome
5. Fabrication of A Folded Antenna
6. Conclusion The folded broadband antenna, and method of fabrication, are described in relation to exemplary antenna configurations using both an archimedean spiral aperture and an interleaved log periodic ("InterLog") aperture, folded into a wedge-shaped leading edge profile for integration with a leading edge radome, such as for the wing of a high-speed aircraft. Both of these folded broadband antenna embodiments exhibit radiation pattern and gain performance comparable in symmetry and uniformity to the corresponding planar antenna configurations.

While the Detailed Description is in relation to these exemplary embodiments, the invention has general applicability to folded antenna configurations using broadband antenna apertures that, in corresponding planar configurations, offer symmetrical radiation pattern performance. Moreover, the invention has general applicability to configuring such antennas with asymmetrical folded geometries, whatever the operating environment.

For the sake of brevity, the Detailed Description focuses of the use on the exemplary folded broadband antenna in the receive mode. The operation of the folded broadband antenna in the transmit mode is reciprocal, in accordance with the rule of reciprocity in antenna theory.

1. Symmetrical Broadband Antennas

As described in the Background, broadband antenna apertures capable of symmetrical radiation pattern performance conventionally have a planar spiral configuration, such as archimedean or logarithmic, although a new broadband antenna with a planar interleaved log periodic configuration is described in the related application.

FIG. 1*a* shows a conventional planar antenna with an archimedean spiral antenna aperture. An archimedean spiral aperture 10 includes two conductive arms 12 and 14 extending outward from a central feedpoint 15 along paths defined by an archimedean spiral. An archimedean spiral may be defined by the expression $r=a\Theta$, where r is the radial distance from the origin to the arm, a is a constant which determines the arm width, and $\Theta$ is the angular position around the antenna axis.

In operation, in the receive mode, an RF signal received by the antenna induces a current in the region where the spiral circumference is near one wavelength, which flows along spiral arms 12 and 14 to the center feedpoint 15. The signal is coupled to a balun that is external to the antenna structure (not shown). Operation in the RF injection/ extraction mode is reciprocal.

FIG. 1*b* shows a planar antenna with an interleaved log periodic (or "InterLog") antenna aperture, which is described in detail in the related application. The InterLog antenna aperture has a number of significant advantages over planar spiral configurations, including (a) polarization independence for circular polarizations, and (b) use of an integral balun structure that allows the antenna to be edge-fed.

In general, an InterLog aperture 20 includes four radial transmission lines 21–24 extending from a central feedpoint 25. Extending from each radial transmission line are interleaved concentric aperture elements 26, forming log periodic dipole sets, 27*a*/27*b* and 28*a*/28*b*.

Orthogonal microstrip or stripline baluns (not shown) are, integrally formed over each radial transmission line from the edge of the aperture to the center feedpoint. Advantageously, this infinite balun configuration allows RF injection/extraction to occur at the edge of the aperture, eliminating the need for connecting an outboard balun directly to the center feedpoint.

In operation, in the receive mode, an RF signal received by the antenna (i.e., by the resonant dipole elements for received frequency) transmits along the corresponding radial transmission lines to the center feedpoint. At the center feedpoint, the received RF is coupled to the associated orthogonal microstrip baluns and transported to the aperture edge for extraction. Operation for RF injection/extraction mode is reciprocal.

FIGS. 1*c* and 1*d* illustrate principle plane (Roll 0° and Roll 90°) antenna amplitude radiation patterns for the free space operation of the archimedean spiral and InterLog antenna apertures. When operating in free space, i.e., without a radome, the radiation pattern for either of these antenna apertures provides symmetrical fixed beam radiation patterns over multi-octave bandwidths.

1. Leading-Edge Radome Induced Distortion

As described in the Background, the symmetrical performance of planar broadband antennas such as the archimedean spiral and the InterLog is severely distorted when installed in a radome with a wedge-shaped geometry, such as for incorporation into the leading edge of an aircraft wing.

FIG. 2*a* illustrates a planar antenna structure incorporated into a leading edge radome. An antenna/radome structure 30 includes a cavity-backed planar antenna structure 32 incorporated within a radome shell 33. The antenna, structure 32 includes an absorber-loaded cavity 34 and an antenna 35 (including an antenna aperture such as an archimedean spiral or an InterLog). Radome shell 33 has a wedge-shaped, leading-edge profile corresponding to the leading edge geometry of an aircraft wing.

Because of the planar configuration of the antenna 35, the antenna structure 32 must be located back from the radome shell 33, creating a forward cavity 36. Thus, the antenna is required to look through both the radome shell 33, and the forward cavity 36.

In this configuration, distortions are induced in the received signals due to internal wall reflections that cause a given region of the antenna 35 to receive signals from different paths. Thus, the same region of the antenna aperture 35 receives a direct-path signal 38 and a multi-path signal 39 that includes an incident path 39*a* and a reflection path 39*b* caused by the internal reflection of the incident signal from the internal wall of the radome shell 33.

For the exemplary application in an aircraft leading edge, the multi-path reflections affect principally the elevation dimension. That is, due to the asymmetric wedge-shaped geometry of the leading edge antenna configuration, the azimuth scan will be much less distorted than the elevation scan.

FIG. 2*b* illustrates an elevation radiation pattern for a planar antenna incorporated into a leading-edge radome. The highly irregular radiation pattern caused by the multi-path distortion effects of the radome makes such an antenna/radome leading edge configuration essentially useless for most broadband applications.

3. Folded Broadband Antenna

The folded broadband antenna configuration of the invention provides broadband performance comparable in gain and symmetry to the performance of corresponding planar broadband antennas. In particular, the folded, wedge-shaped geometry of the invention allows the folded antenna to be integrated directly into a radome with a corresponding wedge-shaped geometry (such as a leading-edge radome), thereby eliminating the forward cavity and resulting symmetry-destroying internal wall reflections.

3.1. Folded Antenna Aperture

FIGS. 3*a* and 3*b* illustrate the folded broadband antenna configuration respectively for the archimedean spiral and the Interlog antenna apertures. For each configuration, the antenna is folded into an asymmetrical wedge-shaped configuration, and the antenna aperture is symmetrically disposed with its center feedpoint on the apex of the folded antenna. Other than folding, the geometry of the antenna aperture is not significantly distorted.

As shown in FIG. 3*a*, a wedge-shaped archimedean antenna 40 with a leading-edge apex 41 includes a folded archimedean-spiral antenna aperture 42 formed on a folded substrate 43. The antenna aperture has a center feedpoint 44 at the apex of the leading edge. The archimedean antenna aperture is folded over an absorber-loaded cavity backing 46 having the desired leading edge geometry. Cavity backing 46 includes a foam layer 47 formed over a three-layer graded absorber 48.

As shown in FIG. 3*b*, a wedge-shaped InterLog antenna 50 with a leading-edge apex 51 includes an InterLog antenna aperture 52 formed on a folded substrate 53. The antenna aperture 52 has a center feedpoint 54 at the apex of the leading edge. The InterLog antenna 50 is folded over an absorber-loaded cavity backing 56 having the desired leading-edge geometry. Cavity-backing 56 includes a layer of foam 57 formed over a three-layer graded absorber 58.

3.2. Antenna Performance

The archimedean spiral and InterLog folded antenna apertures of the invention provide radiation pattern and gain performance comparable in symmetry and uniformity to corresponding planar aperture configurations. The leading edge geometry achievable with these folded antenna apertures allows them to be integrated into a leading edge radome to eliminate any forward cavity, and thereby, to eliminate pattern distortion in the elevation scan due to internal radome shell reflections.

FIGS. 4*a*–4*h* illustrate typical measured radiation patterns for the archimedean spiral aperture, folded according to the invention. The patterns shown are cuts through orthogonal principal planes (Roll 0° and Roll 90°), plus 30° and 60° conical cuts. These pattern measurements were made using a linear polarized horn radiator (providing a continuously rotating linear polarization). Similar radiation patterns were obtained for a folded InterLog antenna aperture.

These radiation patterns indicate that symmetrical performance for the folded antenna configuration of the invention is comparable to that for the corresponding planar antenna aperture configurations (see FIG. 1*d*), albeit polarization sensitivity is degraded somewhat.

Figure 4I:
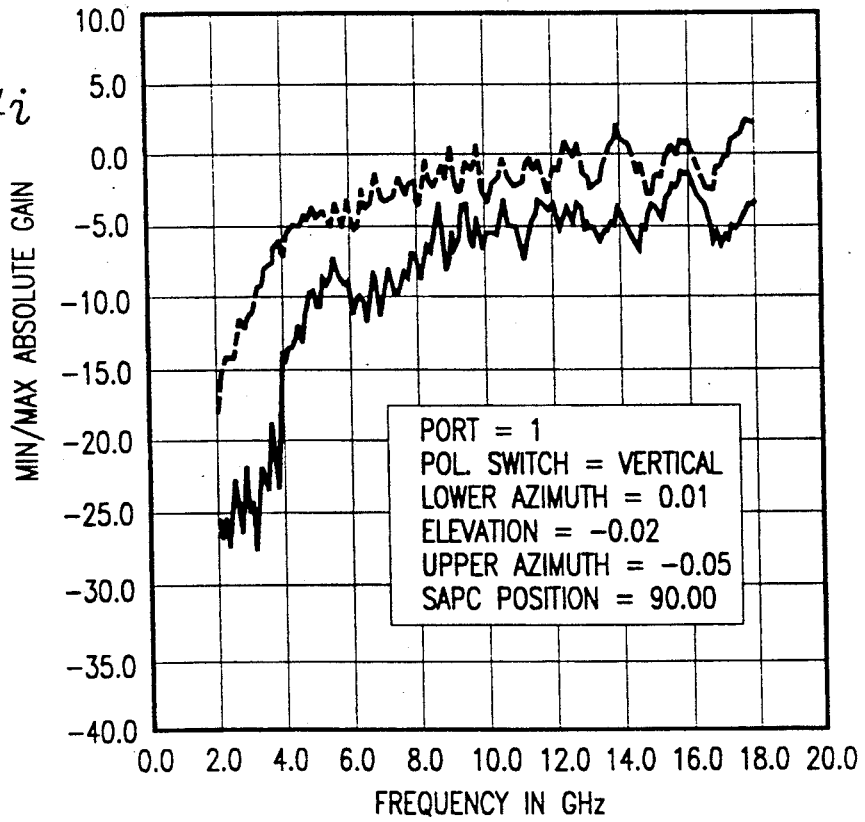
FIG. 4*i* is an illustrative gain plot, for the folded archimedean spiral antenna aperture according to the invention.

For some broadband antenna applications (such as radar warning) for which the folded broadband antenna configuration of the invention would be applicable, a degradation in polarization sensitivity is less critical than for precision direction-finding systems. Thus, for those applications, folded antenna performance should be well within useful, limits, particularly with the application of current signal processing techniques. A plot of antenna gain for minimum and maximum polarization response over the frequency range 2–18 GHz is illustrated in FIG. 4*i*.

3.3. Antenna Structure

The folded broadband antenna structure of the invention includes: (a) an antenna formed by a selected antenna aperture disposed on a semi-rigid substrate; and (b) a wedge-shaped backing cavity with a three-layer graded absorber, configured with a selected leading edge geometry. The specific folded antenna configuration for a given broadband aperture, such as the InterLog or archimedean-spiral, requires structural adaptation to accommodate the associated RF signal injection-/extraction balun.

Figure 5A:
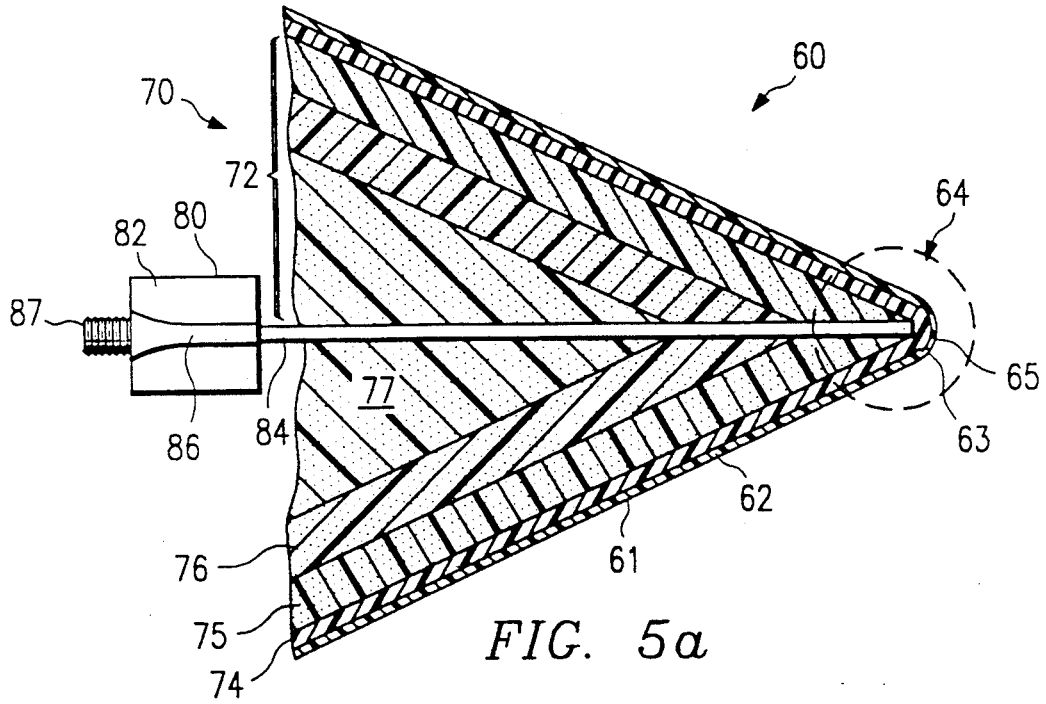
FIGS. 5*a* and 5*b* illustrate a folded antenna structure according to the invention disposed over a wedge-shaped absorber-loaded cavity to achieve a leading-edge profile.
Figure 5B:
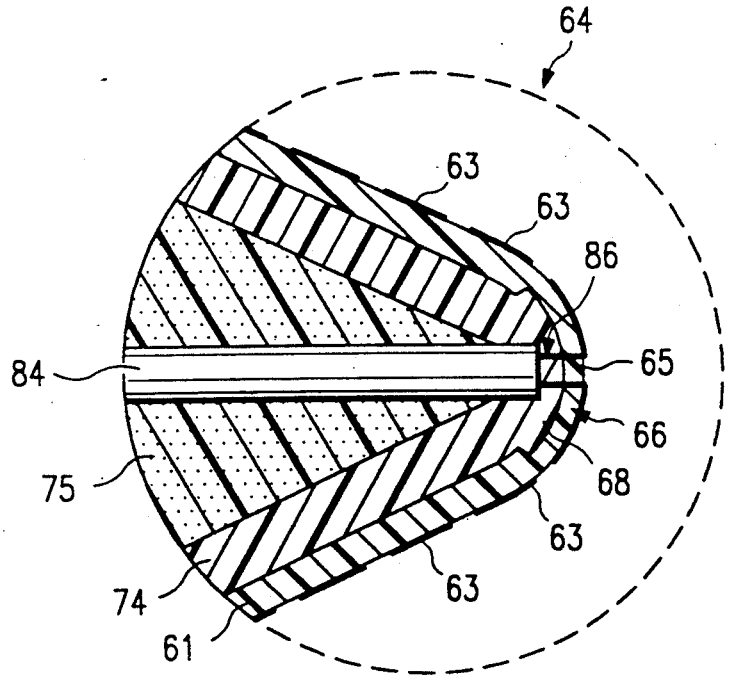

FIGS. 5*a* and 5*b* illustrate a folded broadband antenna structure 60 according to the invention with a rounded-apex wedge-shaped configuration appropriate for a leading-edge profile (illustrated with a 45° fold). FIG. 5*a* illustrates an antenna structure adapted for a center-fed archimedean-spiral antenna aperture, i.e., including a center-feed balun structure.

An antenna structure adapted for an edge-fed InterLog antenna aperture would not require such a center-feed balun structure. The following discussion of the folded broadband antenna structure according to the invention is general in its application to any selected antenna aperture, subject to the requirement for structural adaptation to appropriate feed means.

Selecting a specific configuration for the antenna structure, and in particular the specific leading edge profile, is a design choice that depends on the leading edge geometry and its operating environment (such as in the leading, edge of an aircraft wing). The 45° profile for the antenna structures 60 and 70 is selected for illustrative purposes only, and is not meant to indicate a required or preferred folded antenna configuration.

Referring to FIG. 5*a*, antenna structure 60 includes an antenna aperture 61 of a selected configuration (such as InterLog or archimedean-spiral) formed on a semi-rigid substrate 62. The antenna (aperture/substrate) 61/62 is folded at a central apex 63 to achieve the desired wedge-shaped leading edge profile.

Referring to the detail in FIG. 5*b*, antenna substrate 62 is folded to create an apex region 64. The apex region exhibits a selected apex curvature that determines the leading-edge profile for the folded antenna structure. The antenna aperture 61 is symmetrically disposed with respect to the leading-edge apex 63, with a center feedpoint 65 for the aperture being located at the apex.

For added flexure to facilitate folding, a relatively thin apex substrate section 66 is formed by milling a fold-slot 68 in substrate 62. Because the fold-slot 68 significantly reduces the thickness of the substrate 62 in the apex region, the apex section 66 of the substrate is made flexible enough to permit the substrate to be folded at the leading-edge apex.

Folding creates the rounded apex geometry illustrated for the apex region 64 of the substrate, thereby achieving the desired leading-edge profile. Folding to achieve the desired leading-edge profile may not require that a fold-slot be milled in the apex region, i.e., the leading-edge profile may allow a gradual enough curvature in the apex region to permit flexible folding without reducing the thickness of the substrate. However, as described in Section 3.4.1, the fold-slot offers an additional advantage in terms of locating the balun shielding tube 84 for center-fed antenna aperture applications (such as the archimedean-spiral).

Referring to FIG. 5*a*, the antenna (aperture/substrate) 61/62 is conformably folded along apex-line 63 (apex region 64) over an absorber-loaded backing cavity 70. The backing cavity 70 is configured into the selected wedge-shaped leading-edge geometry for the antenna structure (illustrated as a 45° leading-edge profile).

Backing cavity 70 is formed by a three-layer graded absorber 72, with a structural foam spacer 74 between the absorber and the antenna. The absorber allows unidirectional performance by absorbing back lobe radiation and undesirable reflections from the superstructure behind the antenna.

The performance of absorber-backed antennas is generally improved by including an airspace between the antenna and the absorber, preventing the absorber from attenuating forward-looking signals and reducing antenna gain. Conventionally, this airspace is obtained with a structural foam spacer, such as styrofoam, that is electrically similar to air, but yet provides structural support for the antenna. Selecting the thickness for the structural foam dielectric is a design choice involving a trade-off between insuring that back radiation is adequately suppressed (minimizing the gap) and preventing the absorber from adversely affecting antenna gain through excessive signal attenuation.

The graded absorber 72 is formed by three layers of absorber materials 75, 76 and 77, which absorb back radiation with a minimum of reflection from the absorber interfaces, resulting in uniform pattern and gain performance over the operating band. In accordance with conventional absorber design, the graded absorber allows a gradual transition from a relatively low dielectric constant and low electrical loss, material 75, to a medium dielectric constant and medium loss material 76, to a higher dielectric constant and high loss material 77.

3.4. Balun Feed

The folded antenna structure of the invention is adaptable to a variety of balun feed configurations depending on the type of antenna aperture selected, and to a certain extent, the type of balun. In particular, the archimedean spiral aperture uses a center-feed configuration, while the InterLog antenna aperture uses an edge-feed configuration.

3.4.1. Center-Feed

For the archimedean-spiral antenna aperture, and other broadband symmetrical antenna aperture configurations that cannot be edge-fed, a preferred center feed balun structure is illustrated in FIGS. 5*a* and 5*b*.

FIG. 5*a* shows a balun structure 80 that includes a metallic balun cavity 82 and a conductive balun shielding tube 84. The balun shielding tube extends from the balun cavity through the absorber-loaded backing cavity 70 to a terminus in the apex region 64 of the antenna structure 61/62.

A balun, 86, such as a common exponential tapered balun extends through the balun cavity 82 and the balun shielding tube 84 to the center feedpoint 65 of the antenna aperture, providing a conventional center-feed connection to the antenna aperture at the center-feedpoint. At the injection/extraction end of the balun, coaxial transmission line connection to the center-feed balun is by standard 50 ohm SMA coaxial connector 87.

The configuration of the balun shielding tube (which shields the balun from spurious radiation) and in particular the location of its terminus in the apex region 64 relative to the antenna apex section 66, is selected to provide optimum performance in terms of gain and radiation patterns. Specifically, it is desirable to have the balun shielding tube extend as close to the center feedpoint 65 of the antenna aperture as possible. Minimizing the gap between the center feedpoint and the shielding tube terminus minimizes the exposure of the unshielded portion of the balun 86, and reduces pattern distortion caused by spurious back lobe radiation coupled into the unshielded portion of the balun.

If the conductive balun shielding tube 84 extends too close to the antenna aperture 61, it will couple to the antenna, thereby introducing pattern distortions and affecting antenna gain. An advantage of the configuration of the apex area 64, and in particular the fold-slot 68, is that the apex substrate section 66 is significantly reduced in thickness, thereby permitting the balun shielding tube to be extended further up the balun, reducing the extent of the unshielded portion of the balun while still maintaining a sufficient gap between the balun shielding tube and the antenna aperture 61.

The selection of an optimum gap between the balun shielding tube and the antenna aperture is a design choice, taking into account the above described design trade-off between undesired antenna coupling to the shield tube and radiation from the unshielded portion of the balun.

For the exemplary folded archimedean-spiral antenna, the gap between the balun shielding tube and the underside of the antenna apex substrate section 66 is about 35 mils, and the thickness of the substrate after milling to create the fold-slot 68 was about 3–7 mils. The central fold-slot was milled to about 0.25 inches wide, removing about 12 mils to leave the substrate thickness of about 3–7 mils, just enough to provide a minimum of structural support for the antenna aperture disposed on the substrate.

3.4.2. Edge-Feed

One of the advantages of an InterLog antenna aperture is that it employs an integral infinite balun, eliminating the need for an outboarded center-feed balun structure coupled to the leading-edge apex of the antenna. Rather, the Interlog antenna can be edge-fed, eliminating the need for an external balun along the antenna axis (i.e., perpendicular to the plane of the antenna) for connection to the center feedpoint at the antenna apex. Thus, at the leading-edge apex of the antenna, where the environmental stresses are the greatest, there is no fragile feedpoint connection that is subject to failure.

The edge-feed integral balun configuration is described in detail in the related application. Generally, the InterLog antenna aperture accommodates orthogonal microstrip baluns that are formed over the radial transmission lines (21–24 in FIG. 1*a*), extending from the edge of the antenna aperture to the center feedpoint (15 in FIG. 1*a*). These microstrip baluns are an integral part of the etched log periodic geometry.

Thus, the InterLog antenna can be edge-fed (RF injection/extraction) by coupling a coaxial transmission line conductor to the integral balun at the edge of the antenna aperture, with RF energy being transported by the baluns to/from the center feedpoint. The transmission line center conductor is connected to the microstrip line conductor, and the coaxial transmission line shield is connected to the log periodic elements at the aperture outer edge.

4. Integration Into A Leading-Edge Radome

For an exemplary application, the folded broadband antenna structure of the invention is integrated into a radome for incorporation into the leading edge of an aircraft wing. The leading edge geometry of the radome is dictated by aerodynamic and structural considerations, which in turn determine the leading edge geometry for the integral folded antenna structure, as illustrated in FIG. 6.

Figure 6:
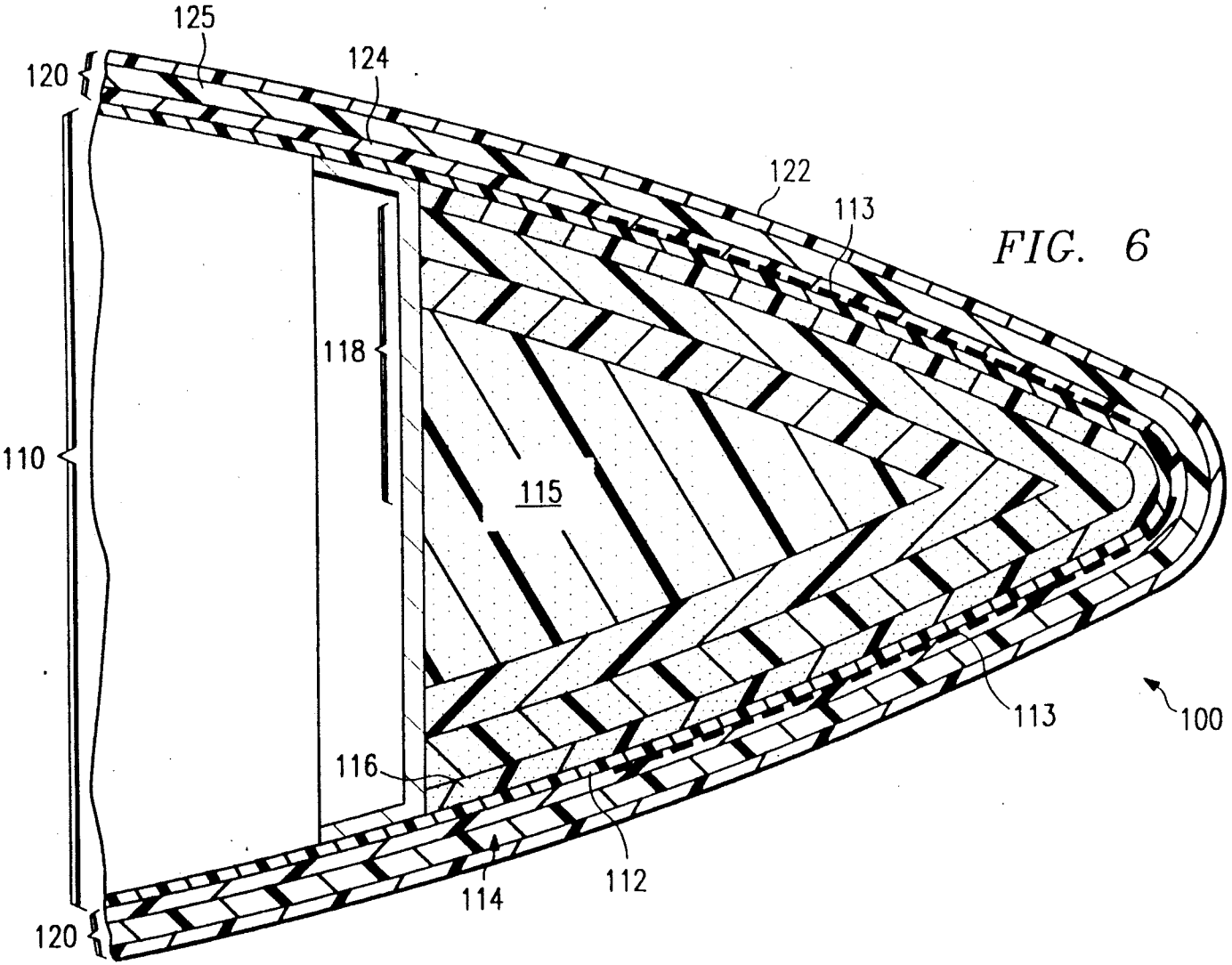
FIG. 6 illustrates a cavity-backed folded spiral antenna structure incorporated into a leading-edge radome shell.

FIG. 6 shows a leading edge antenna/radome structure 100 that includes a folded broadband symmetrical antenna structure 110 according to the invention, integrated with a leading-edge radome shell 120. In particular, both the antenna structure 110 and the radome shell 120 are configured with the same selected leading-edge profile such that the antenna aperture can be structurally integrated into the inner layer of the radome shell, eliminating any forward cavity between the antenna aperture and the radome, and thereby eliminating any internal wall reflections.

The folded antenna structure 110 includes an antenna 112 formed by an antenna aperture 113 disposed on an antenna substrate 114. The antenna 112 is conformably folded over an absorber-loaded cavity backing 118 with the desired leading-edge geometry. The absorber-loaded cavity includes a structural foam spacer 116 and a three-layer graded absorber 118.

The exemplary leading-edge radome 120 uses a conventional multi-layer configuration to provide the structural properties typical of such radomes. Specifically, the multi-layer radome shell includes two high density skins 122 and 124, sandwiching a low density core 125 such as honeycomb. The balun feed for the antenna structure is not shown.

Integration of the antenna structure 110, and in particular the antenna aperture 113, into the radome shell 120 can be accomplished by a number of techniques. For example, the antenna structure and the radome shell can be separately prefabricated, and then conformably integrated by installing the radome shell over the antenna structure and bonding the folded antenna aperture to the inner wall of the radome shell. Alternatively, the antenna structure can be prefabricated, and then the radome shell fabricated over the antenna using conventional radome fabrication techniques, embedding the antenna aperture in the inner layer of the shell.

5. Fabrication

The folded broadband antenna structure of the invention is fabricated from three principle components: (a) the antenna, including the antenna aperture and the underlying substrate, (b) the absorber-loaded cavity, including the structural foam spacer and the three-layer graded absorber, and (c) the balun.

The antenna substrate may be fabricated from a conventional semi-rigid dielectric material such as fiberglass, with a thickness of about 15–20 mils. The substrate is covered with a layer of one ounce thick copper which is etched to provide the selected antenna aperture configuration.

If the apex curvature for the selected leading-edge profile is relatively sharp, or if the preferred center feed balun configuration is used (see Section 3.4), the back of the substrate is then milled to create a central fold-slot. As described in Section 3.4, the fold-slot permits the substrate to be flexibly folded into the selected leading edge profile, and/or permits an axial balun shielding tube to be extended closer to the antenna aperture. Thus, if the leading edge, profile exhibits a gradual apex curvature and the aperture is edge-fed (obviating the balun shielding tube), this milling step may be avoided.

Referring to FIGS. 5*a* and 5*b*, the back of the substrate is milled to create the fold-slot 68 by removing approximately 12 to 15 mils of the fiberglass substrate, leaving an apex substrate section 66 of approximately 3 to 7 mils. The thickness of the remaining substrate under the antenna pattern in the apex area 64 is not critical—it should be made as thin as possible while still providing structural support for the antenna aperture. The width of the fold-slot is dependent upon the final folded configuration of the antenna, i.e., on the final geometry of the apex area 64. For typical leading edge geometries, a fold-slot width of approximately 0.25" would be appropriate.

The fabrication of the cavity backing for the antenna structure, including the graded absorber and the structural foam spacer, is conventional and need not be described in detail. Typical of absorbers that can be used for the absorber layers 75, 76 and 77 are, respectively, Emerson & Cumming Company types LS22, LS24 and LS26. Additionally, a carbon-loaded honeycomb absorber, also available from Emerson & Cumming, will work and provide a structural support for the antenna. The optimum thickness of the foam dielectric spacer is determined empirically. A foam dielectric gap of about 62 mils is appropriate for the folded antenna configurations of the invention.

Fabrication of the tapered balun structures for spiral antennas are conventional and need not be described in detail. The edge-fed balun for the InterLog aperture is described in detail in the related patent.

6. Conclusion

The folded broadband antenna of the invention provides antenna performance comparable to that of planar broadband antennas, such as the cavity backed archimedean spiral or log periodic. In particular, the folded antenna aperture configuration provides acceptable broadband performance in terms of radiation pattern, field-of-view and gain.

The folded broadband antenna can be fabricated with a leading-edge profile, for integration with a leading-edge radome. Integration with the radome shell eliminates any forward cavity between the antenna aperture and the radome shell, thereby eliminating internal wall reflections that would distort antenna performance. For unidirectional performance, the folded antenna structure can be formed over a graded and tapered absorber-loaded cavity.

For those folded antenna applications requiring a relatively sharply folded apex geometry, a fold-slot can be milled in the back of the antenna substrate. The fold-slot forms an apex line of geometrical symmetry that includes the center feedpoint for the antenna aperture, and provides an apex region that is sufficiently flexible to permit folding the antenna structure into the desired wedge-shaped geometry.

For center-fed antenna apertures, an axial balun structure includes a balun shielding tube that extends axially from the balun cavity into proximity with the center feedpoint of the aperture at the antenna apex. The use of a fold-slot configuration for the antenna apex allows the gap between the balun shield tube and the antenna aperture to be minimized.

What is claimed is:

1. A folded broadband antenna, having a substantially symmetrical, broadband radiation pattern, comprising:

(a) a substrate;

(b) a folded antenna aperture including a radiating element that exhibits broadband substantially symmetrical radiation pattern performance disposed on said substrate;

(c) said folded antenna aperture and substrate having a fold along an apex in a wedge shaped geometry with a selected profile, said apex forming a line of symmetry for said folded antenna aperture;

(d) said substrate having a reduced thickness in the region along said fold; and (e) a feed element shield disposed in said folded antenna and extending to said fold at said region of reduced thickness.

2. The folded antenna of claim 1, further comprising a cavity behind said folded antenna aperture, and an absorber material disposed in the cavity behind said folded antenna aperture to provide a radiation pattern for said folded antenna aperture which is substantially unidirectional.

3. The folded antenna of claim 2, wherein:

said absorber material forms a wedge-shaped geometry with substantially the same profile as said folded antenna aperture;

said folded antenna aperture being folded over said cavity to provide said folded antenna aperture.

4. The folded antenna of claim 2, further comprising an air spacer disposed between said absorber material and said folded antenna aperture.

5. The folded antenna of claim 4 wherein said air spacer is a foam.

6. The folded antenna of claim 2 wherein said absorber material provides a transition in a direction extending away from said folded antenna aperture from relatively low dielectric constant and low loss to relatively high dielectric contant and high loss.

7. The folded antenna of claim 6 wherein said absorber material comprises in a direction extending away from said folded antenna aperture a layer of relatively low dielectric constant and low loss followed by a layer of relatively medium dielectric constant and medium loss followed by a layer of relatively high dielectric constant and high loss.

8. The folded antenna of claim 1, wherein said folded antenna aperture is a log periodic configuration.

9. The folded antenna of claim 1, wherein said folded antenna aperture is an archimedean spiral configuration.

10. A folded broadband antenna that is center fed, having a substantially symmetrical radiation pattern, comprising:

(a) an antenna aperture that exhibits broadband substantially symmetrical performance;

(b) said antenna aperture including a center feedpoint;

(c) said antenna aperture being folded along an apex into a wedge-shaped geometry with a selected profile and providing a cavity behind said antenna aperture;

(d) said apex forming a lone of symmetry for said folded aperture, including said center feedpoint; and (e) a transmission line coupled to said center feedpoint of injecting-extracting RF energy into/from said antenna aperture;

(f) a conductive shielding the cavity behind said folded antenna line and extending through the cavity behind said folded antenna aperture to a terminus adjacent to said center feedpoint on said apex; and (g) a balun extending through said shielding tube, and coupled to said center feedpoint.

11. The center-fed folded antenna of claim 10, wherein said antenna aperture is a spiral configuration.

12. The center-fed folded antenna of claim 11, wherein said antenna aperture is an archimedean spiral configuration.

13. The center-fed folded antenna of claim 10, further including a gap between the terminus of said shielding tube and said antenna aperture wherein said gap is selected to minimize the length of unshielded balun extending between such terminus and said antenna aperture to obtain uniform broadband radiation pattern performance.

14. The center-fed folded antenna of claim 10, further comprising a substrate, said folded antenna aperture being disposed on said substrate, with the combination being designated an antenna.

15. The center-fed folded antenna of claim 14, wherein said antenna includes a fold slot formed in said substrate along said apex to increase flexure of said antenna at said apex.

16. The center-fed folded antenna of claim 15, wherein said shielding tube extends to a terminus within said fold slot.

17. The center-fed folded antenna of claim 16, further including a gap between the terminus of said shielding tube and said antenna aperture wherein the gap is selected to minimize the length of unshielded balun extending between such terminus and said antenna aperture commensurate with selected pattern and gain performance.

18. The center-fed folded antenna of claim 10, further comprising:

a cavity behind said antenna aperture; and an absorber material disposed in the cavity behind said antenna aperture, such that the radiation pattern for said antenna aperture is substantially unidirectional;

said shielding tube extending through said absorber.

19. A folded broadband antenna, having a substantially symmetrical, broadband radiation pattern, comprising:

(a) a substrate;

(b) a folded antenna aperture including a radiant element that exhibits broadband substantially symmetrical performance disposed on said substrate;

(c) said folded antenna aperture and substrate having a fold along an apex in a wedge shaped geometry with a selected profile, said apex forming a line of symmetry for said folded antenna aperture and a cavity behind said folded antenna aperture; and (d) an absorber disposed in the cavity behind said folded antenna aperture.

20. The folded antenna of claim 19 wherein said absorber is in a wedge-shaped geometry with substantially the same profile as said folded aperture.

21. The folded antenna of claim 20 wherein said absorber provides a transition in a direction extending away from said folded antenna aperture from relatively low dielectric constant and low loss to relatively high dielectric constant and high loss.

22. The folded antenna of claim 21 wherein said absorber comprises in a direction extending away from said folded antenna aperture a layer of relatively low dielectric constant and low loss followed by a layer of relatively medium dielectric constant and medium loss followed by a layer of relatively high dielectric constant and high loss.

23. The folded antenna of claim 22, further comprising an air spacer disposed between said absorber and said folded antenna aperture.

24. The folded antenna of claim 23 wherein said air spacer is a foam.

25. The folded antenna of claim 21, further comprising an air spacer disposed between said absorber and said folded antenna aperture.

26. The folded antenna of claim 20, further comprising an air spacer disposed between said absorber and said folded antenna aperture.

27. The folded antenna of claim 19, further comprising an air spacer disposed between said absorber and said folded antenna aperture.

28. The folded antenna of claim 27 wherein said air spacer is a foam.

29. A radome/antenna structure with folded broadband antenna having a substantially symmetrical radiation pattern, comprising:

(a) a radome formed into a wedge-shaped geometry with a selected profile; and (b) a folded broadband antenna, having a substantially symmetrical, broadband radiation pattern, comprising:

(i) a substrate;

(ii) a folded antenna aperture including a radiating element that exhibits broadband substantially symmetrical radiation performance disposed on said substrate;

(iii) said folded antenna aperture and substrate having a fold along an apex in a wedge shaped geometry with the same profile as said radome, said apex forming a line of symmetry for said folded antenna aperture;

(iv) said substrate having a reduced thickness in the region along said fold; and (v) a feed element shield disposed in said folded antenna aperture and extending to said fold at said region of reduced thickness.

30. The radome/antenna of claim 29, further comprising a cavity behind said folded antenna aperture, and an absorber material disposed in said cavity behind said folded antenna aperture to provide a radiation pattern for said antenna aperture which is substantially unidirectional.

31. The radome/antenna of claim 30, wherein:

said absorber forms a wedge-shaped geometry with substantially the same profile as said folded antenna aperture, said folded antenna aperture being folded over said cavity.

32. The radome/antenna of claim 30, further comprising an air spacer disposed over between said absorber and said folded antenna aperture.

33. The radome/antenna of claim 30 wherein said absorber material provides a transition in a direction extending away from said folded antenna aperture form relatively low dielectric constant and low loss to relatively high dielectric constant and high loss.

34. The radome/antenna of claim 30 wherein said absorber material comprises in a direction extending away from said folded antenna aperture a layer of relatively low dielectric constant and low loss followed by a layer of relatively medium dielectric constant and medium loss followed by a layer of relatively high dielectric constant and high loss.

35. The radome/antenna of claim 29 wherein said folded antenna aperture is a log periodic configuration.

36. The radome/antenna of claim 29 wherein said folded antenna aperture is an archimedean spiral configuration .

37. A broadband radome/antenna structure wherein the antenna is center fed, having a substantially symmetrical radiation pattern, comprising:

(a) a radome formed into a wedge-shaped geometry with a selected profile; and (b) an antenna aperture that, in a planar configuration, exhibits broadband substantially symmetrical radiation pattern performance, said aperture including:

(i) a center feedpoint;

(ii) said antenna aperture being folded along an apex into a wedge-shaped geometry with substantially the same profile as said radome;

(iii) said apex forming a line of symmetry for said folded antenna aperture, including said center feedpoint; and (iv) a transmission line coupled to said center feedpoint for injecting/extracting RF energy into/-from said antenna aperture;

(v) a cavity behind said antenna aperture;

(vi) a conductive shielding tube surrounding said transmission line and extending through the cavity behind said antenna aperture to a terminus adjacent said center feedpoint on said apex; and (vii) a balun extending through said shielding tube, and coupled to said center feedpoint.

38. A radome/antenna structure of claim 37 wherein said antenna aperture is a spiral configuration.

39. The radome/antenna structure of claim 38 where said antenna aperture is an archimedean spiral configuration.

40. The radome/antenna structure of claim 37 wherein the gap between the terminus of said shielding tube and said antenna aperture is selected to minimize the length of unshielded balun extending between such terminus and said aperture without excessive attenuation of RF energy.

41. The radome/antenna structure of claim 37 further comprising a substrate, said folded antenna aperture being disposed on said substrate, with the combination being designated an antenna.

42. The radome/antenna structure of claim 41 wherein said antenna includes a fold slot formed in said substrate along said apex to increase flexure of said antenna at said apex.

43. The radome/antenna structure of claim 42 wherein said shielding tube extends to a terminus within said folded slot.

44. The radome/antenna structure of claim 43 wherein the gap between the terminus of said shielding tube and said antenna aperture is selected to minimize the length of unshielded balun extending between such terminus and said antenna aperture commensurate with selected pattern and gain performance.

45. The radome/antenna structure of claim 37, further comprising:

a cavity behind the folded antenna aperture; and an absorber material disposed in the cavity behind said folded antenna aperture, such that the radiation pattern for said antenna aperture is substantially unidirectional;

said shielding tube extending through said absorber.

46. A radome/antenna system having a folded broadband antenna, having a substantially symmetrical, broadband radiation pattern, comprising:

(a) a radome formed into a wedge-shaped geometry with a selected profile; and (b) an antenna comprising:

(i) a substrate;

(ii) a folded antenna aperture including a radiant element that exhibits broadband substantially symmetrical performance disposed on said substrate;

(iii) said folded antenna aperture and substrate having a fold along an apex in a wedge geometry with substantially the same profile as said radome;

(iv) said apex forming a line of symmetry for said folded antenna aperture;

(v) a cavity behind said folded antenna aperture; and (vi) an absorber disposed in the cavity behind said folded antenna aperture.

47. The radome/antenna of claim 46 wherein said absorber is formed into a wedge-shaped geometry with substantially the same profile as said folded antenna aperture.

48. The radome/antenna of claim 47 wherein said absorber provides a transition in a direction extending away from said folded antenna aperture from relatively low dielectric constant and low loss to relatively high dielectric constant and high loss.

49. The radome/antenna of claim 48 wherein said absorber comprises, in a direction extending away from said folded antenna aperture, a layer of relatively low dielectric constant and low loss followed by a layer of relatively medium dielectric constant and medium followed by a layer of relatively high dielectric constant and high loss.

50. The radome/antenna of claim 49, further comprising an air spacer disposed over between said absorber and said folded antenna aperture.

51. The folded antenna of claim 50 wherein said air spacer is a foam.

52. The radome/antenna of claim 48, further comprising an air spacer disposed over between said absorber and said folded antenna aperture.

53. The radome/antenna of claim 47, further comprising an air spacer disposed over between said absorber and said folded antenna aperture.

54. The radome/antenna of claim 46, further comprising an air spacer disposed over between said absorber and said folded antenna aperture.

55. The folded antenna of claim 54 wherein said air spacer is a foam.

* * * * *